US007854092B2

(12) United States Patent
Stoffels

(10) Patent No.: US 7,854,092 B2
(45) Date of Patent: Dec. 21, 2010

(54) MEZZANINE GATE SYSTEM

(75) Inventor: Richard B. Stoffels, Eden Prairie, MN (US)

(73) Assignee: Garlock Equipment Company, Minneapolis, MN (US)

( * ) Notice: Subject to any disclaimer, the term of this patent is extended or adjusted under 35 U.S.C. 154(b) by 483 days.

(21) Appl. No.: 12/047,433

(22) Filed: Mar. 13, 2008

(65) Prior Publication Data

US 2009/0229185 A1 Sep. 17, 2009

(51) Int. Cl.
*E05C 7/06* (2006.01)

(52) U.S. Cl. ..... 49/109; 49/104; 49/107; 49/114

(58) Field of Classification Search ..... 49/104, 49/107, 108, 109, 110, 111, 112, 114, 68; 105/425; 104/27, 29
See application file for complete search history.

(56) References Cited

U.S. PATENT DOCUMENTS

| | | | | |
|---|---|---|---|---|
| 150,282 | A * | 4/1874 | Brooks | 49/110 |
| 2,874,819 | A | 2/1959 | Nutter | |
| 3,188,759 | A | 6/1965 | Lowrey | |
| 4,041,646 | A | 8/1977 | Mittag | |
| 4,150,510 | A | 4/1979 | Harrison et al. | |
| 4,538,379 | A | 9/1985 | Vargo | |
| 5,701,701 | A | 12/1997 | Derosiers | |
| 5,709,050 | A | 1/1998 | Benko | |
| 6,009,670 | A | 1/2000 | Howard | |
| 2004/0164288 | A1 * | 8/2004 | Williamson | 256/73 |

FOREIGN PATENT DOCUMENTS

| | | |
|---|---|---|
| GB | 2197373 | 5/1988 |

* cited by examiner

*Primary Examiner*—Jerry Redman
(74) *Attorney, Agent, or Firm*—Alan Kamrath; Kamrath & Associates PA

(57) ABSTRACT

A gate system (10) includes two spaced sides (12, 14) defining a work area (16) between the sides (12, 14). A first opening (18) is defined between first ends of the sides (12, 14), and a second opening (38) opposite to the first opening (18) is defined between second ends of the sides (12, 14). Two gates (82, 92) for opening/closing the first and second openings (18, 38) are respectively coupled with two shafts (40, 50) rotatably supported by one of the sides (12, 14). The shafts (40, 50) are rotatably interconnected wherein pivoting of one of the gates (82, 92) in a direction causes pivoting of the other gate (82, 92) in an opposite direction. Each gate (82, 92) includes a groove (85, 95) that receives a vertical beam (60, 62) of the other side (14) when the gate (82, 92) is in a closed position. Biasing elements in the form of gas cylinders (110, 120) between the side (12) and the gates (82, 92) prevent the gates (82, 92) from slamming into their closed positions.

19 Claims, 5 Drawing Sheets

MEZZANINE GATE SYSTEM

BACKGROUND OF THE INVENTION

The present invention relates to a mezzanine gate system and, more particularly, to a mezzanine gate system having two opposite gates that simultaneously pivot about pivot axes perpendicular to the gates.

Mezzanine gate systems provide protection for workers on a mezzanine or the like and generally include two side rails defining inner and outer openings and inner and outer gates for opening/closing the inner and outer openings. One of the inner and outer gates is closed when the other gate is open. Pallets on which material is placed can be moved to and from the mezzanine by a fork lift truck or the like when the outer gate is open whereas the inner gate is closed such that the fork lift truck or the like can not be unintentionally driven through the inner opening and possibly off a loading dock or the like. In an approach to provide simultaneous opening/closing of the inner and outer gates for the purposes of protecting the workers on the mezzanine by insuring that at least one gate is closed when one gate is open, the inner and outer gates are connected by an L-shaped or V-shaped frame therebetween. The frame is pivotably connected between the side rails about a pivot axis perpendicular to the side rails. The frame is pivotally movable like a seesaw between a first position in which the inner gate is closed whereas the outer gate is open and a second position in which the outer gate is closed whereas the inner gate is open. However, conventional mezzanine gate systems suffer from various deficiencies and limitations including but not limited to that the frame occupies a considerable space above the side rails.

A need exists for a mezzanine gate system that can be easily and economically manufactured and can be utilized in various places for various purposes.

BRIEF SUMMARY OF THE INVENTION

The present invention solves this need and other problems in the field of mezzanine gate systems by providing, in a preferred form, a gate system including two sides spaced from each other and defining a work area therebetween. A first opening is defined between first ends of the sides, and a second opening is defined between second ends of the sides and opposite to the first opening. First and second shafts are rotatably supported by one of the sides. A first gate is pivotably mounted to the first end of one of the sides and coupled with the first shaft to rotate therewith. The first gate defines a first plane for closing or opening the first opening. The first gate is pivotably movable in the first plane about a first pivot axis perpendicular to the first plane between a first open position allowing passage to and from the work area through the first opening and a first closed position preventing passage through the first opening. A second gate is pivotably mounted relative to the second end of one of the sides. The second gate is coupled with the second shaft to rotate therewith. The second gate defines a second plane for closing or opening the second opening. The second gate is pivotably movable in the second plane about a second pivot axis perpendicular to the second plane between a second open position allowing passage to and from the work area through the second opening and a second closed position preventing passage through the second opening. The first and second shafts are rotatably interconnected wherein pivoting of one of the first and second gates in a direction causes pivoting of the other of the first and second gates in an opposite direction. Thus, the first and second gates pivot simultaneously in opposite directions so that the first gate is in the first open position when the second gate is in the second closed position and that the first gate is in the first closed position when the second gate is in the second open position.

In the most preferred form, the first and second shafts respectively define the first and second pivot axes parallel to each other and preferably are coaxial to each other. Furthermore, in a most preferred form, the first and second shafts are in reverse gear interconnection wherein rotation of one of the first and second shafts in a rotation direction causes rotation of the other shaft in an opposite rotation direction. A support rail is provided in one of the sides for supporting the reverse gear interconnection. The first gate is directly fixed to the first shaft to rotate therewith, and the second gate is directly fixed to the second shaft to rotate therewith.

The gate system can further include suitable provisions to prevent the first and second gates from slamming into their closed positions. In a preferred form, a first gas cylinder has a first end attached to the first side and a second end attached to the first gate. A second gas cylinder has a first end attached to the first side and a second end attached to the second gate. The first gas cylinder is extended and the second gas cylinder is retracted when the first gate is in the first open position and the second gate is in the second closed position. The first gas cylinder is retracted and the second gas cylinder is extended when the first gate is in the first closed position and the second gate is in the second open position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
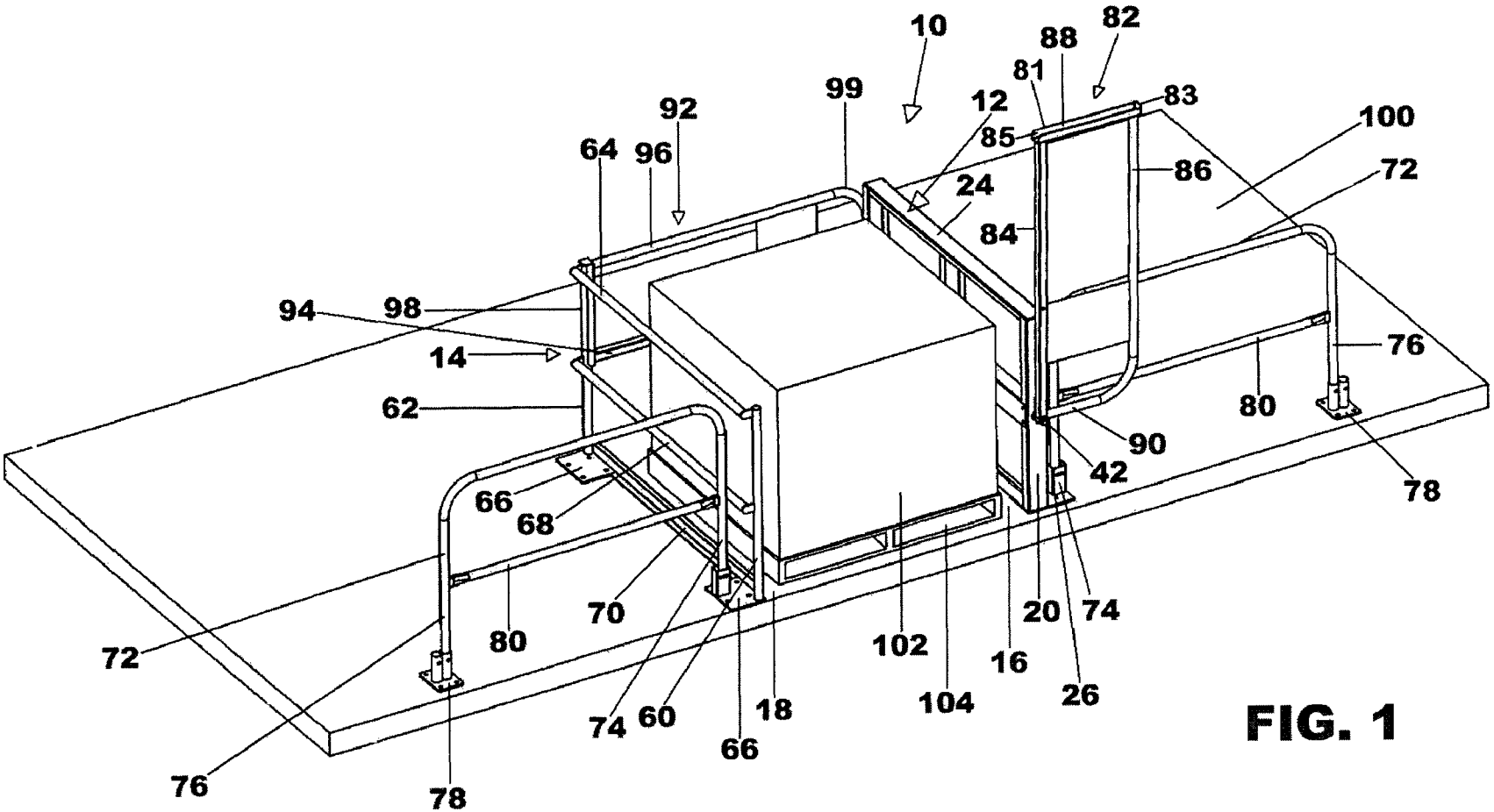
FIG. 1 shows a front, perspective view of a gate system of an embodiment according to the preferred teachings of the present invention with an outer, first gate opened and with an inner, second gate closed.
Figure 2:
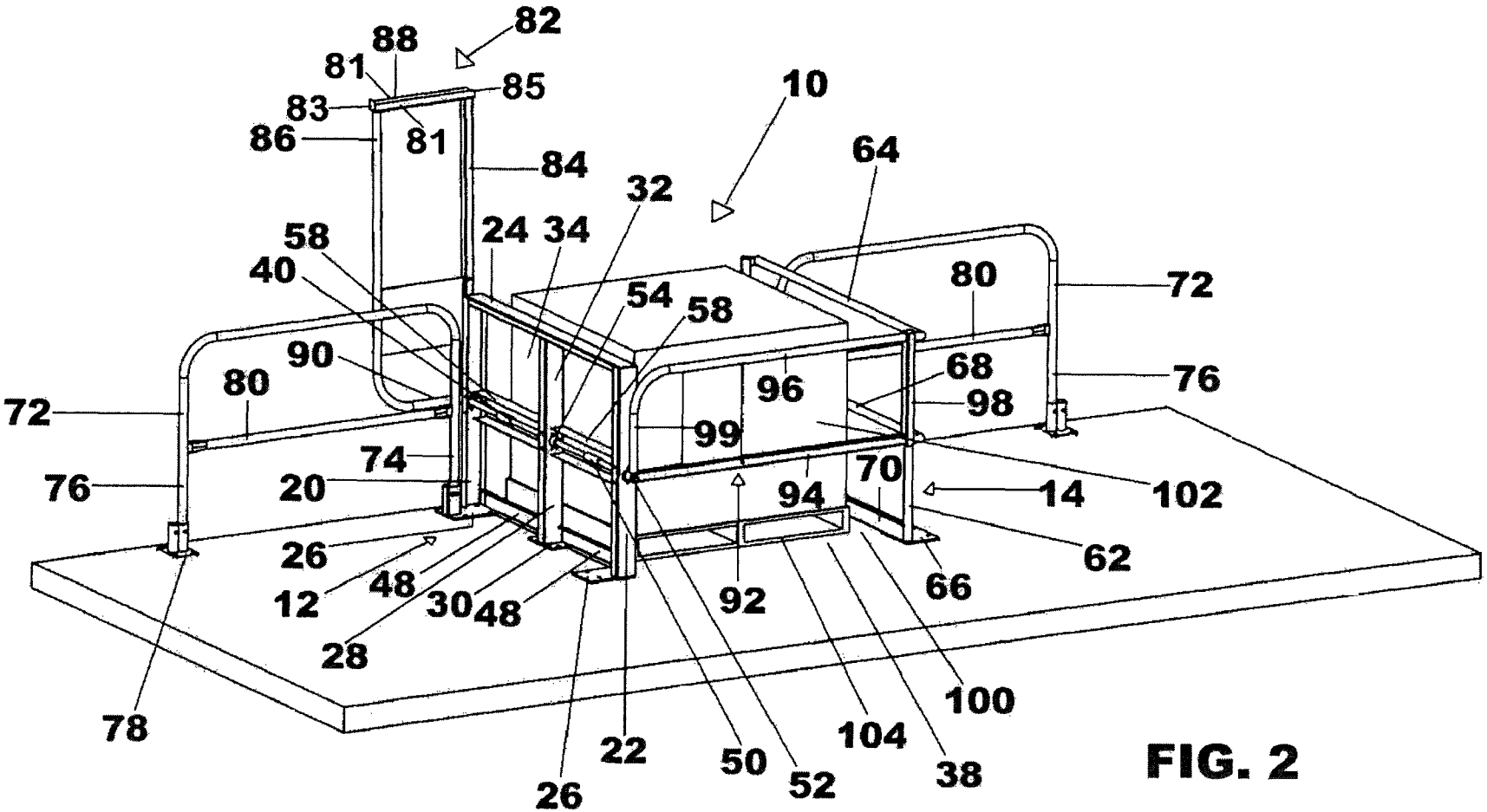
FIG. 2 shows a rear, perspective view of the gate system of FIG. 1 with the outer, first gate opened and with the inner, second gate closed.
Figure 3:
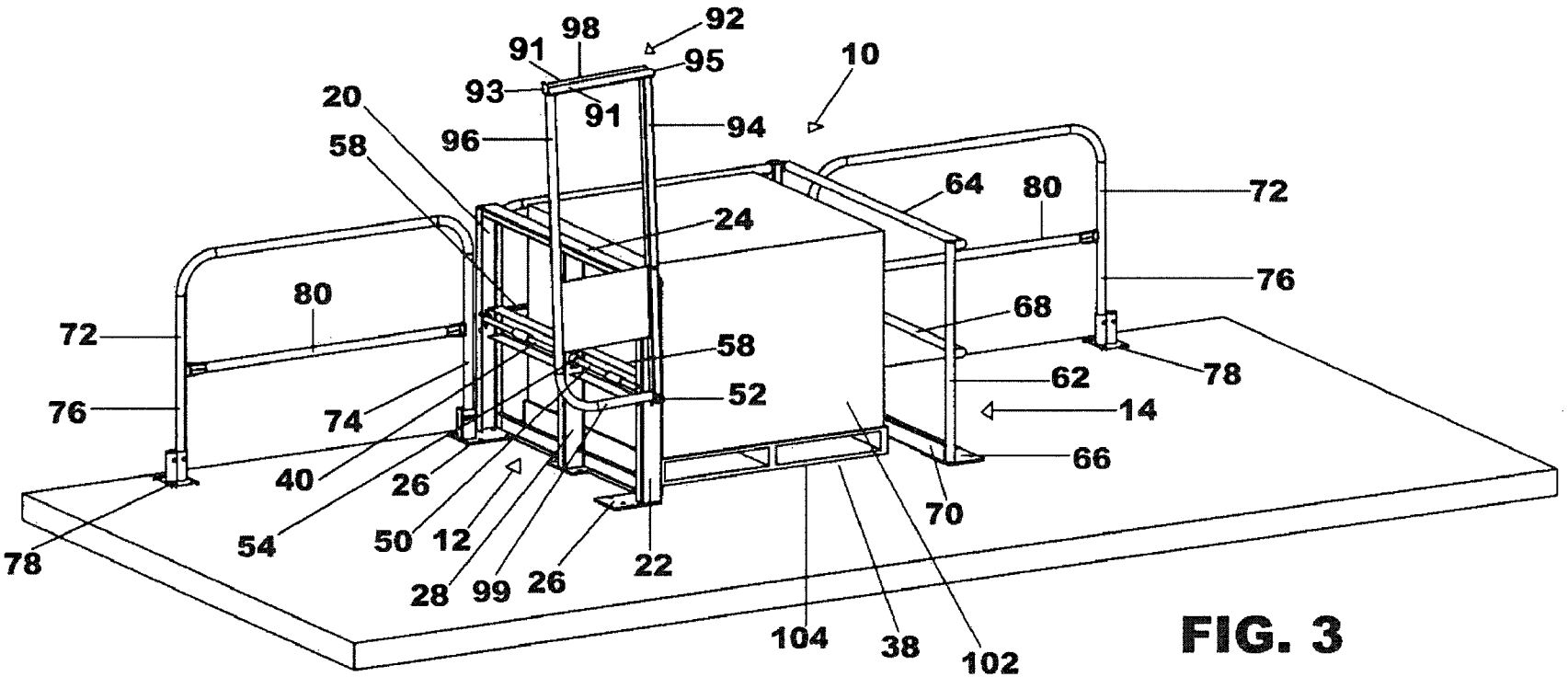
FIG. 3 shows a rear, perspective view of the gate system of FIG. 1 with the outer, first gate closed and with the inner, second gate opened.
Figure 4:
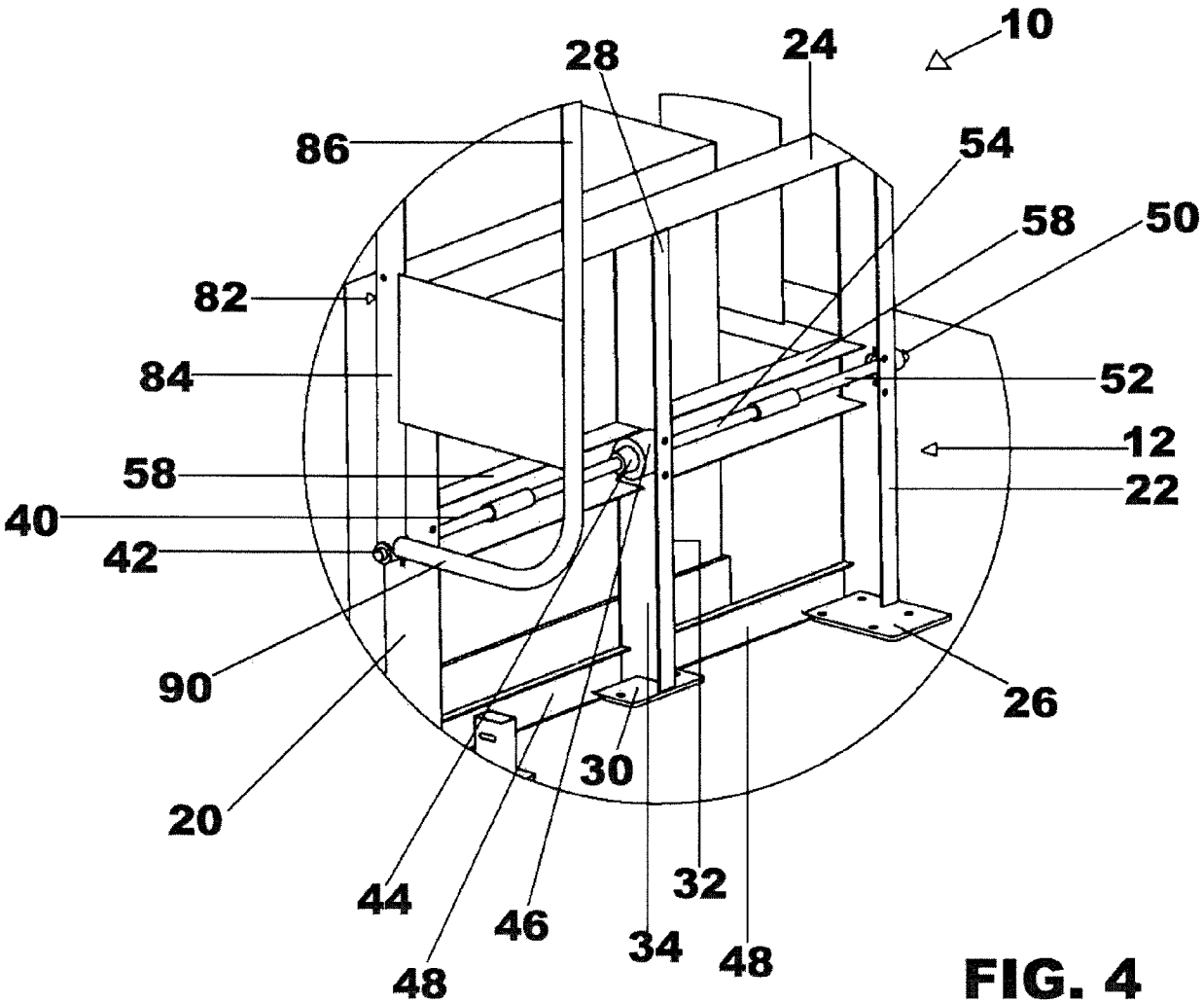
FIG. 4 shows a partial, perspective view of the gate system of FIG. 1.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "lower", "upper", "side", "end", "portion", "section", "vertical", "inner", "outer", "spacing", "forward", "rearward", "length", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A gate system according to the preferred teachings of the present invention is shown in the drawings and generally designated 10. According to the preferred form shown, gate system 10 is mounted on an elevated storage and work platform 100 such as a mezzanine for storage of material 102 and for protecting workers on the platform 100. Material 102 can be placed on a pallet 104 that can be moved by a fork lift truck or the like to and from platform 100.

Gate system 10 includes first and second sides 12 and 14 in the preferred form shown as parallel rails defining a work area 16 therebetween. Specifically, first side 12 includes first and second parallel, spaced, vertical beams 20 and 22 extending upward from platform 100 that serves as a floor for the work area 16. First side 12 further includes a top beam 24 interconnected between upper ends of first and second vertical beams 20 and 22. Lower ends of first and second vertical beams 20, 22 are fixed to platform 100 through front and rear mounting plates 26 by bolts or the like. A vertical support rail 28 is mounted between first and second vertical beams 20 and 22 and includes a lower end fixed through a mounting plate 30 by bolts or the like to platform 100 and an upper end fixed to top beam 24. Support rail 28 includes two opposite sides 32 and 34 facing first and second vertical beams 20 and 22. U-shaped brackets 48 are mounted between the lower ends of first vertical beam 20 and support rail 28 and between the lower ends of second vertical beam 22 and support rail 28 for reinforcing first side 12. Other methods for fixing first and second beams 20 and 22 and support rail 28 on platform 100 would be within the skill of the art.

According to the preferred form shown, gate system 10 further includes a first shaft 40 having two ends rotatably supported by intermediate portions of first vertical beam 20 and support rail 28. First shaft 40 includes a front section 42 extending forward beyond first vertical beam 20. Gate system 10 further includes a second shaft 50 parallel to first shaft 40 and having two ends rotatably supported by intermediate portions of second vertical beam 22 and support rail 28. Second shaft 50 includes a rear section 52 extending rearward beyond second vertical beam 22. A rear end 44 of first shaft 40 and a front end 54 of second shaft 50 are in reverse gear interconnection 46 such that rotation of one of first and second shafts 40, 50 in a rotation direction causes rotation of the other shaft 40, 50 in an opposite rotation direction. In the most preferred form shown, first and second shafts 40 and 50 are coaxial to each other, and reverse gear interconnection 46 extends through opposite sides 32, 34 of support rail 28. Reverse gear connection 46 can be but not limited to a purchased component. U-shaped brackets 58 are provided between the intermediate portions of first vertical beam 20 and support rail 28 and between the intermediate portions of second vertical beam 22 and support rail 28 for reinforcing first side 12, for protecting first and second shafts 40, 50 from being damaged during handling of material 102 and for protecting workers in work area 16 from being injured by first and second shafts 40 and 50.

According to the preferred form shown, second side 14 includes third and fourth parallel, spaced, vertical beams 60 and 62 having a spacing therebetween the same as that between first and second vertical beams 20 and 22. Specifically, first and second sides 12 and 14 are coextensive and parallel to each other. A first opening 18 is defined between first and third vertical beams 20 and 60 and perpendicular to first and second sides 12 and 14. A second opening 38 opposite to first opening 18 is defined between second and fourth vertical beams 22 and 62 and perpendicular to first and second sides 12 and 14. Second side 14 further includes a top beam 64 interconnected between upper ends of third and fourth vertical beams 60 and 62. Lower ends of third and fourth vertical beams 60, 62 are fixed to platform 100 through front and rear mounting plates 66 by bolts or the like. To reinforce second side 14, a U-shaped bracket 70 is mounted between lower ends of third and fourth vertical beams 60 and 62, and a connecting bar 68 is interconnected between intermediate portions of third and fourth vertical beams 60 and 62. Other methods for fixing third and fourth beams 60 and 62 on platform 100 would be within the skill of the art.

According to the preferred form shown, two safety rails 72 are mounted on opposite sides of work area 16 and outside first and second sides 12 and 14 for preventing workers from falling from a front side of platform 100. Each safety rail 72 of the preferred form shown is substantially inverted U-shaped and has a first leg 74 fixed to one of front mounting plates 26, 66. Each safety rail 72 further has a second leg 76 fixed to platform 100 through a mounting plate 78 by bolts or the like. A connecting bar 80 is interconnected between intermediate portions of legs 74 and 76. Other forms of safety rails 72 would be within the skill of the art. Safety rails 72 could be connected to or part of a rail system, wall, or the like located at the edge of the platform 100.

According to the preferred form shown, gate system 10 further includes an outer, first gate 82 shown in a most preferred form of a substantially rectangular rail including two spaced, parallel beams 84 and 86 and two beams 88 and 90 interconnected between beams 84 and 86. First gate 82 defines a first plane perpendicular to first and second sides 12 and 14 for closing or opening first opening 18. Specifically, beam 84 has an end fixed to front section 42 of first shaft 40. Beam 88 is interconnected between the other end of beam 84 and an end of beam 86. Beam 88 is substantially U-shaped and includes two parallel, spaced vertical sides 81 and a top side 83 interconnected between vertical sides 81, with beam 88 and sides 81 and 83 forming a groove 85 therebetween. Beam 90 has an end portion fixed to front section 42 of first shaft 40. The other end portion of beam 90 is connected to the other end of beam 86. Beams 84 and 86 have a length slightly larger than a width of first opening 18. Thus, first gate 82 is pivotably mounted relative to first side 12 and rotates together with first shaft 40 in the first plane perpendicular to a first pivot axis defined by first shaft 40 between an open position allowing passage to and from work area 16 through first opening 18 and a closed position preventing passage through first opening 18.

According to the preferred form shown, gate system 10 further includes an inner, second gate 92 shown in a most preferred form of a substantially rectangular rail including two spaced, parallel beams 94 and 96 and two beams 98 and 99 interconnected between beams 94 and 96. Second gate 92 defines a second plane parallel to the first plane for closing or opening second opening 38. Specifically, beam 94 has an end fixed to rear section 52 of second shaft 50. Beam 98 is interconnected between the other end of beam 94 and an end of beam 96. Beam 98 is substantially U-shaped and includes two parallel, spaced vertical sides 91 and a top side 93 interconnected between vertical sides 91, with beam 98 and sides 91 and 93 forming a groove 95 therebetween. Beam 99 has an end portion fixed to rear section 52 of second shaft 50. The other end portion of beam 99 is connected to the other end of beam 96. Beams 94 and 96 have a length slightly larger than a width of second opening 38. Thus, second gate 92 is pivotably mounted relative to first side 12 and rotates together with second shaft 50 in the second plane perpendicular to a second pivot axis defined by second shaft 50 between an open position allowing passage to and from work area 16 through second opening 38 and a closed position preventing passage through second opening 38.

Now that the basic construction of gate system 10 of FIGS. 1-4 of the preferred teachings of the present invention has been explained, the operation and some of the advantages of gate system 10 can be set forth and appreciated. In particular, for the sake of explanation, it will be assumed that first gate 82 is in its open position whereas second gate 92 is in its closed position (FIG. 1). Material 102 placed on pallet 104 can be loaded on or unloaded from work area 16 by a fork lift truck or the like. Since second gate 92 is closed while first gate 82 is open for handling material 102, improved safety is provided. It can be appreciated that first gate 82 in its open position does not interfere with material handling operation. Vertical sides 91 and top side 93 of beam 98 of second gate 92 in the closed position abut with front, back, and top of fourth vertical beam 62 that is received in groove 95 to support second gate 92. After handling of material 102, first gate 82 is manually pivoted 90 degrees in a direction to its closed position, and second gate 92 pivots 90 degrees in an opposite direction to its open position (FIGS. 2 and 3) due to reverse gear connection 46 between first and second shafts 40 and 50. First gate 82 in the closed position prevents material 102 and workers from falling off platform 100. Vertical sides 81 and top side 83 of beam 88 of first gate 82 in the closed position abut with front, back, and top of third vertical beam 60 that is received in groove 85 to support first gate 82 and to prevent further downward movement of first gate 82 beyond the closed position. Second gate 92 in the open position allows further material handling, if necessary.

Figure 5:
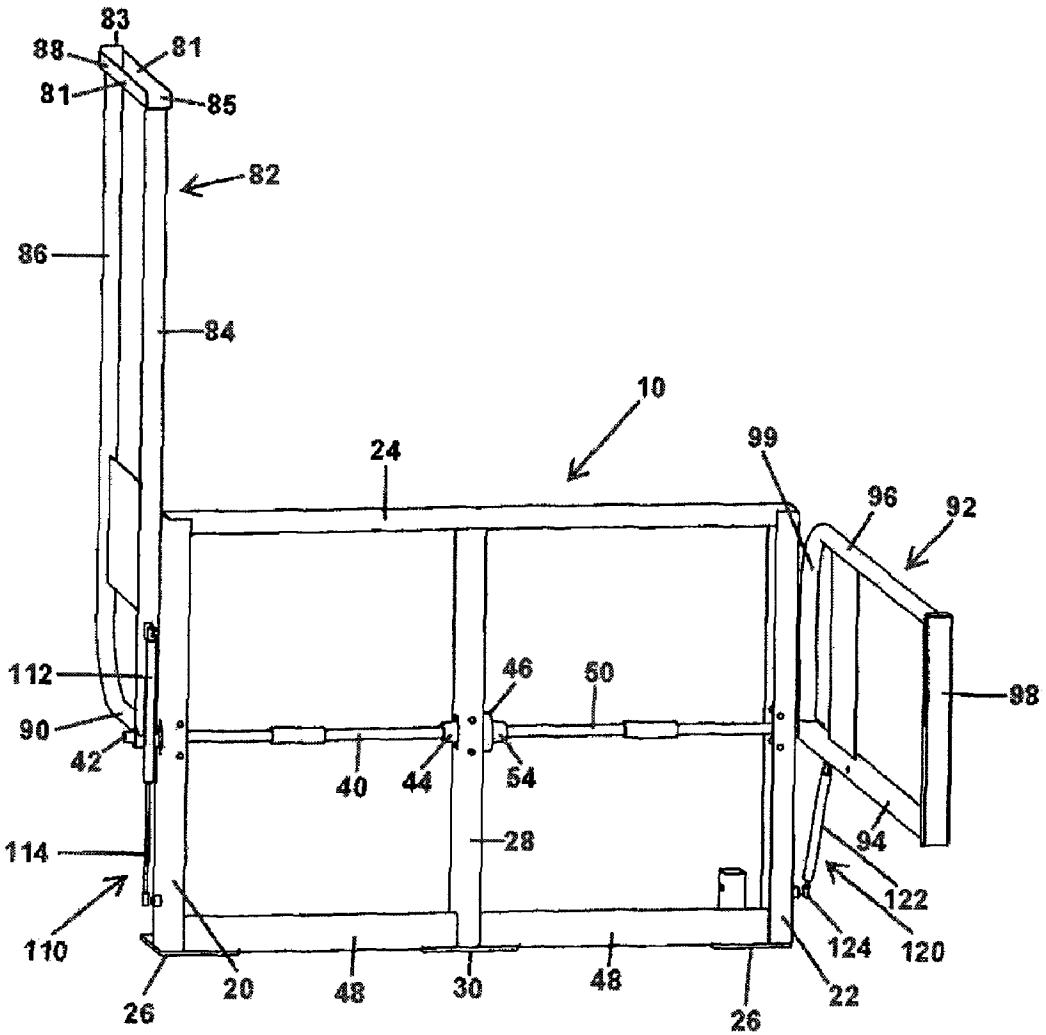
FIG. 5 shows a partial, perspective view of another embodiment of the gate system according to the preferred teachings of the present invention with an outer, first gate opened and with an inner, second gate closed and with a side of the gate system omitted for clarity.

FIG. 5 shows another embodiment of the gate system 10 according to the preferred teachings of the present invention including suitable provisions to prevent first and second gates 82 and 92 from slamming down into their closed positions. Specifically, in the preferred form shown, such provisions are in the form of first and second biasing elements shown in the most preferred form as first and second gas cylinders 110 and 120. Particularly, first gas cylinder 110 includes a cylinder 112 having an end fixed to beam 84 of first gate 82. First gas cylinder 110 further includes a rod 114 having an inner end slideably received in cylinder 112. Rod 114 further has an outer end attached to first vertical beam 20. First gas cylinder 110 is movable between an extended position supporting first gate 82 in its open position and a retracted position when first gate 82 is in its closed position. Second gas cylinder 120 includes a cylinder 122 having an end fixed to beam 94 of second gate 92. Second gas cylinder 120 further includes a rod 124 having an inner end slideably received in cylinder 122. Rod 124 further has an outer end attached to second vertical beam 22. Second gas cylinder 120 is movable between an extended position supporting second gate 92 in its open position and a retracted position when second gate 92 is in its closed position. First gas cylinder 110 extends when second gas cylinder 120 retracts. On the other hand, first gas cylinder 110 retracts when second gas cylinder 120 extends. Thus, due to movement of second gas cylinder 120 to its extended position and of first gas cylinder 110 to its retracted position, first gate 82 will not slam down into its closed position, preventing top side 83 of beam 88 of first gate 82 from hitting the top of third vertical beam 60 when moving first gate 82 from its open position to its closed position. Likewise, due to movement of second gas cylinder 120 to its retracted position and of first gas cylinder 110 to its extended position, second gate 92 will not slam down into its closed position, preventing top side 93 of beam 98 of second gate 92 from hitting the top of fourth vertical beam 62 when moving second gate 92 from its open position to its closed position.

Now that the basic teachings of the present invention have been explained, many extensions and variations will be obvious to one having ordinary skill in the art. For example, work area 16 can have other shapes than right parallelepipeds including where sides 12 and 14 and gates 82 and 92 are linear such as rhombi, trapezoids, or the like, or where sides 12 and 14 and gates 82 and 92 are not linear. Likewise, first and second sides 12 and 14 and gates 82 and 92 can have other forms such as panels, walls, screens, or the like. Furthermore, first and second shafts 40 and 50 can be interconnected by other mechanical transmission devices including but not limited to chains, belts, gears and combinations thereof. Furthermore, one of first and second shafts 40 and 50 can be connected to and driven by motors such as step motors controllable by buttons or a remote control so that manual movement of first and second gates 82 and 92 is not required.

In the preferred form, the biasing elements are shown as gas cylinders 110 and 120 which are believed to be advantageous aesthetically and functionally. Specifically, first and second gas cylinders 110 and 120 act in both directions to reliably support first and second gates 82 and 92 in their open positions and to reliably prevent first and second gates 82 and 92 from slamming into their closed positions. Further, first and second gas cylinders 110 and 120 do not create a pinch zone that would exist such as between spring coils, avoiding injury to the workers on platform 100. However, the biasing elements can take other forms according to the teachings of the present invention including but not limited to spring elements and hydraulic and pneumatic cylinders.

It can be appreciated that all of the operative parts of gate system 10 according to the preferred teachings of the present invention are on one side 12 so that it can be factory fabricated and that it is not necessary to install relatively moveable components in the field. Specifically, it is only necessary to attach gates 82 and 92 to first and second shafts 40 and 50, and it is not necessary to attach drive interconnection components. Furthermore, aside from gates 82 and 92, no other parts of gate system 10 according to the preferred teachings of the present invention extend between first and second sides 12 and 14 so that nothing extends across the top which restricts the height of material 102, the fork lift truck, etc. Further, the width between first and second sides 12 and 14 can be varied, and it is only necessary to select the length of gates 82 and 92 to correspond to the desired width between first and second sides 12 and 14.

Although mounting shafts 40 and 50 to side 12 is advantageous, first and second shafts 40 and 50 can be mounted to different sides 12 and 14 according to the preferred teachings of the present invention. Particularly, suitable transmission arrangements can be utilized to allow simultaneous pivotal movement of first and second gates 82 and 92 between open and closed positions according to the teachings of the present invention.

Gate system 10 according to the preferred teachings of the present invention has a simple structure and can be manufactured at low costs. Furthermore, gate system 10 according to the preferred teachings of the present invention allows simultaneous pivotal movement of first and second gates 82 and 92 through simple operation. Furthermore, gate system 10 according to the preferred teachings of the present invention can be utilized in places other than platform 100.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A gate system comprising, in combination:

first and second sides spaced from each other and defining a work area therebetween, with each of the first and second sides including first and second ends, with a first opening being defined between the first ends of the first and second sides, and with a second opening being defined between the second ends of the first and second sides and opposite to the first opening;

a first shaft rotatably supported by one of the first and second sides;

a second shaft rotatably supported by one of the first and second sides;

a first gate pivotably mounted relative to the first end of one of the first and second sides, with the first gate being coupled with the first shaft to rotate therewith, with the first gate defining a first plane for closing or opening the first opening, with the first gate being pivotably movable in the first plane about a first pivot axis perpendicular to the first plane between a first open position allowing passage to and from the work area through the first opening and a first closed position preventing passage through the first opening; and a second gate pivotably mounted relative to the second end of one of the first and second sides, with the second gate being coupled with the second shaft to rotate therewith, with the second gate defining a second plane for closing or opening the second opening, with the second gate being pivotably movable in the second plane about a second pivot axis perpendicular to the second plane between a second open position allowing passage to and from the work area through the second opening and a second closed position preventing passage through the second opening, with the first and second shafts being rotatably interconnected wherein pivoting of one of the first and second gates in a direction causes pivoting of the other of the first and second gates in an opposite direction, with the first and second gates pivoting simultaneously in opposite directions, with the first gate being in the first open position when the second gate is in the second closed position, and with the first gate being in the first closed position when the second gate is in the second open position.

2. The gate system as claimed in claim 1, with the first and second shafts respectively defining the first and second pivot axes and being parallel to each other.

3. The gate system as claimed in claim 2, with the first and second shafts being rotatably supported in the first side and in a reverse rotation interconnection wherein rotation of one of the first and second shafts in a rotation direction causes rotation of the other of the first and second shafts in an opposite rotation direction.

4. The gate system as claimed in claim 3, with the first and second shafts being coaxial with each other.

5. The gate system as claimed in claim 4, with the first side further including a support rail between the first and second ends thereof, with the support rail extending in a vertical plane perpendicular to the first and second pivot axes and having two opposite sides, and with the reverse rotation interconnection of the first and second shafts extending through the two opposite sides and supported by the support rail.

6. The gate system as claimed in claim 5, with the first and second sides being parallel to each other.

7. The gate system as claimed in claim 6, with the first and second planes being parallel to each other, with the first and second openings being perpendicular to the first and second sides, and with the first and second sides being coextensive and perpendicular to the first and second planes.

8. The gate system as claimed in claim 6, with the first side being a first rail including a first vertical beam extending upward from a floor of the work area and forming the first end of the first side, with the first rail further including a second vertical beam extending upward from the floor of the work area and forming the second end of the first side, with the first rail further including a top beam interconnected between upper ends of the first and second vertical beams, with the first shaft including a first section rotatably extending through the first vertical beam, and with the second shaft including a second section rotatably extending through the second vertical beam.

9. The gate system as claimed in claim 8, with the first gate being a second rail including two spaced, parallel third beams, with the second rail further including two fourth beams each including two end portions interconnected between the third beams, with the third and fourth beams forming the first plane, with the second gate being a third rail including two spaced, parallel fifth beams, with the third rail further including two sixth beams each including two end portions interconnected between the fifth beams, and with the fifth and sixth beams forming the second plane.

10. The gate system as claimed in claim 9, with one of the third beams being fixed to the first section of the first shaft, with one of the two end portions of one of the two fourth beams being fixed to the first section of the first shaft, with one of the fifth beams being fixed to the second section of the second shaft, and with one of the two end portions of one of the two sixth beams being fixed to the second section of the second shaft.

11. The gate system as claimed in claim 10, with another of the two fourth beams being substantially U-shaped and including two parallel, spaced first vertical sides and a first top side interconnected between the two first vertical sides, with a first groove defined between the two first vertical sides and the first top side, with the second side further including a third vertical beam extending upward from the floor of the work area and forming the first end of the second side, with the third vertical beam including a front, a back, and a top, with the third vertical beam being received in the first groove and with the two first vertical sides and the first top side of the other fourth beam of the first gate abutting with the front, the back and the top of the third vertical beam when the first gate is in the first closed position.

12. The gate system as claimed in claim 11, with the second side further including a fourth vertical beam extending upward from the floor of the work area and forming the second end of the second side, with the fourth vertical beam including a front, a back, and a top, with another of the two sixth beams being substantially U-shaped and including two parallel, spaced second vertical sides and a second top side interconnected between the two second vertical sides, with a second groove defined between the two second vertical sides and the second top side, with the fourth vertical beam being received in the second groove and with the two second vertical sides and the second top side of the other sixth beam of the second gate abutting with the front, the back and the top of the fourth vertical beam when the second gate is in the second closed position.

13. The gate system as claimed in claim 12, further comprising, in combination: a first biasing element having a first end attached to the first side and a second end attached to the first gate; and a second biasing element having a first end attached to the first side and a second end attached to the second gate, with the first biasing element being extended and the second biasing element being retracted when the first gate is in the first open position and the second gate is in the second closed position, with the first biasing element being retracted and the second biasing element being extended when the first gate is in the first closed position and the second gate is in the second open position, with the first and second biasing elements preventing the first top side of the other fourth beam of the first gate from slamming on the top of the third vertical beam when the first gate is moving from the first open position to the first closed position and preventing the second top side of the other sixth beam of the second gate from slamming on the top of the fourth vertical beam when the second gate is moving from the second open position to the second closed position.

14. The gate system as claimed in claim 5, with the first gate being rotatably mounted relative to the first end of the first side by the first shaft.

15. The gate system as claimed in claim 14, with the second gate being rotatably mounted relative to the second end of the first side by the second shaft.

16. The gate system as claimed in claim 15, with the first and second sides being parallel to each other.

17. The gate system as claimed in claim 16, with the first and second planes being parallel to each other, with the first and second openings being perpendicular to the first and second sides, and with the first and second sides being coextensive and perpendicular to the first and second planes.

18. The gate system as claimed in claim 3, further comprising, in combination: a first biasing element having a first end attached to the first side and a second end attached to the first gate; and a second biasing element having a first end attached to the first side and a second end attached to the second gate, with the first biasing element being extended and the second biasing element being retracted when the first gate is in the first open position and the second gate is in the second closed position, and with the first biasing element being retracted and the second biasing element being extended when the first gate is in the first closed position and the second gate is in the second open position, with the first and second biasing elements preventing the first gate from slamming on the second side when the first gate is moving from the first open position to the first closed position and preventing the second gate from slamming on the second side when the second gate is moving from the second open position to the second closed position.

19. The gate system as claimed in claim 1, with the first gate being rotatably mounted relative to the first end of the first side by the first shaft, and with the second gate being rotatably mounted relative to the second end of the first side by the second shaft.

* * * * *

UNITED STATES PATENT AND TRADEMARK OFFICE

CERTIFICATE OF CORRECTION

PATENT NO. : 7,854,092 B2
APPLICATION NO. : 12/047433
DATED : December 21, 2010
INVENTOR(S) : Richard B. Stoffels It is certified that error appears in the above-identified patent and that said Letters Patent is hereby corrected as shown below:

Column 8, line 15, cancel "6" and substitute therefore --5--.

Signed and Sealed this
Fifth Day of April, 2011

David J. Kappos

David J. Kappos
*Director of the United States Patent and Trademark Office*